US010081037B2

(12) United States Patent
Käske

(10) Patent No.: US 10,081,037 B2
(45) Date of Patent: Sep. 25, 2018

(54) SYSTEMS FOR TREATING WORKPIECES

(71) Applicant: Ecoclean GmbH, Filderstadt (DE)

(72) Inventor: Egon Käske, Aachen (DE)

(73) Assignee: Ecoclean GmbH, Filderstadt (DE)

( * ) Notice: Subject to any disclaimer, the term of this patent is extended or adjusted under 35 U.S.C. 154(b) by 210 days.

(21) Appl. No.: 14/834,163

(22) Filed: Aug. 24, 2015

(65) Prior Publication Data

US 2015/0360262 A1 Dec. 17, 2015

Related U.S. Application Data

(63) Continuation-in-part of application No. PCT/EP2014/053632, filed on Feb. 25, 2014.

(30) Foreign Application Priority Data

Feb. 25, 2013 (DE) ..... 10 2013 203 059

(51) Int. Cl.
*B08B 3/14* (2006.01)
*B08B 3/04* (2006.01)

(52) U.S. Cl.
CPC . *B08B 3/14* (2013.01); *B08B 3/04* (2013.01)

(58) Field of Classification Search
None
See application file for complete search history.

(56) References Cited

U.S. PATENT DOCUMENTS 7,032,435 B2 * 4/2006 Hassenflug ..... G01F 1/28 340/603
7,857,909 B2 * 12/2010 Kaske ..... B08B 3/04 134/103.1
2010/0080904 A1 * 4/2010 Merry ..... C23C 16/45502 427/255.15

FOREIGN PATENT DOCUMENTS

| | | |
|---|---|---|
| CA | 2458432 | 8/2005 |
| DE | 37314110 | 4/1989 |
| DE | 4446587 | 6/1996 |
| DE | 19609783 | 9/1997 |
| DE | 102006039715 | 2/2008 |
| WO | 2008022701 | 2/2008 |
| WO | 2014128307 | 8/2014 |

OTHER PUBLICATIONS

Patent Cooperation Treaty, English version of "International Preliminary Report on Patentability," issued in connection with PCT Patent Application No. PCT/EP2014/053632, dated Sep. 3, 2015, 10 pages.

(Continued)

*Primary Examiner* — Rita P Adhlakha
(74) *Attorney, Agent, or Firm* — Hanley, Flight and Zimmerman, LLC

(57) ABSTRACT

Systems for treating workpieces are disclosed. A disclosed apparatus for treating workpieces with process fluid in a flooding chamber includes a container to provide process fluid, a process fluid delivery line that fluidly couples the container to the flooding chamber to provide process fluid to the flooding chamber, where the process fluid delivery line includes a container-side inflow region, and means for generating a process fluid jet that is to flow to the flooding chamber and pass through the container-side inflow region of the process fluid delivery line.

18 Claims, 2 Drawing Sheets

(56) References Cited

OTHER PUBLICATIONS

Patent Cooperation Treaty, English version of "International Search Report," issued in connection with PCT Patent Application No. PCT/EP2014/053632, dated Jun. 4, 2014, 8 pages.
Patent Cooperation Treaty, "Written Opinion," issued in connection with PCT Patent Application No. PCT/EP2014/053632, dated Jun. 4, 2014, 7 pages.
German Patent Office, "Search Report," issued in connection with German Patent Application No. 10 2013 203 059.2, dated Nov. 14, 2013, 5 pages.

* cited by examiner

SYSTEMS FOR TREATING WORKPIECES

RELATED APPLICATIONS

This patent arises as a continuation-in-part of International Patent Application No. PCT/EP2014/053632, which was filed on Feb. 25, 2014, which claims priority to German Patent Application No. 10 2013 203 059, which was filed on Feb. 25, 2013. The foregoing International Patent Application and German Patent Application are hereby incorporated herein by reference in their entireties.

FIELD OF THE DISCLOSURE

This disclosure relates generally to workpiece contamination, and, more particularly, to systems for treating workpieces.

BACKGROUND

Dirt particles (e.g., particular chip material, dust, casting sand or liquid droplets) can impair the function of industrially produced products such as, for example, injection nozzles for internal combustion engines. Thus, the cleanliness of workpieces in industrial production processes is of great importance. Use is therefore made in industrial manufacturing of systems for treating workpieces, in which the workpieces are cleaned and deburred. In such cleaning systems, the workpieces are subjected to a process fluid such as water, for example, which is provided, preferably, with cleaning additives, or to fluid which contains hydrocarbons.

Figure 1:
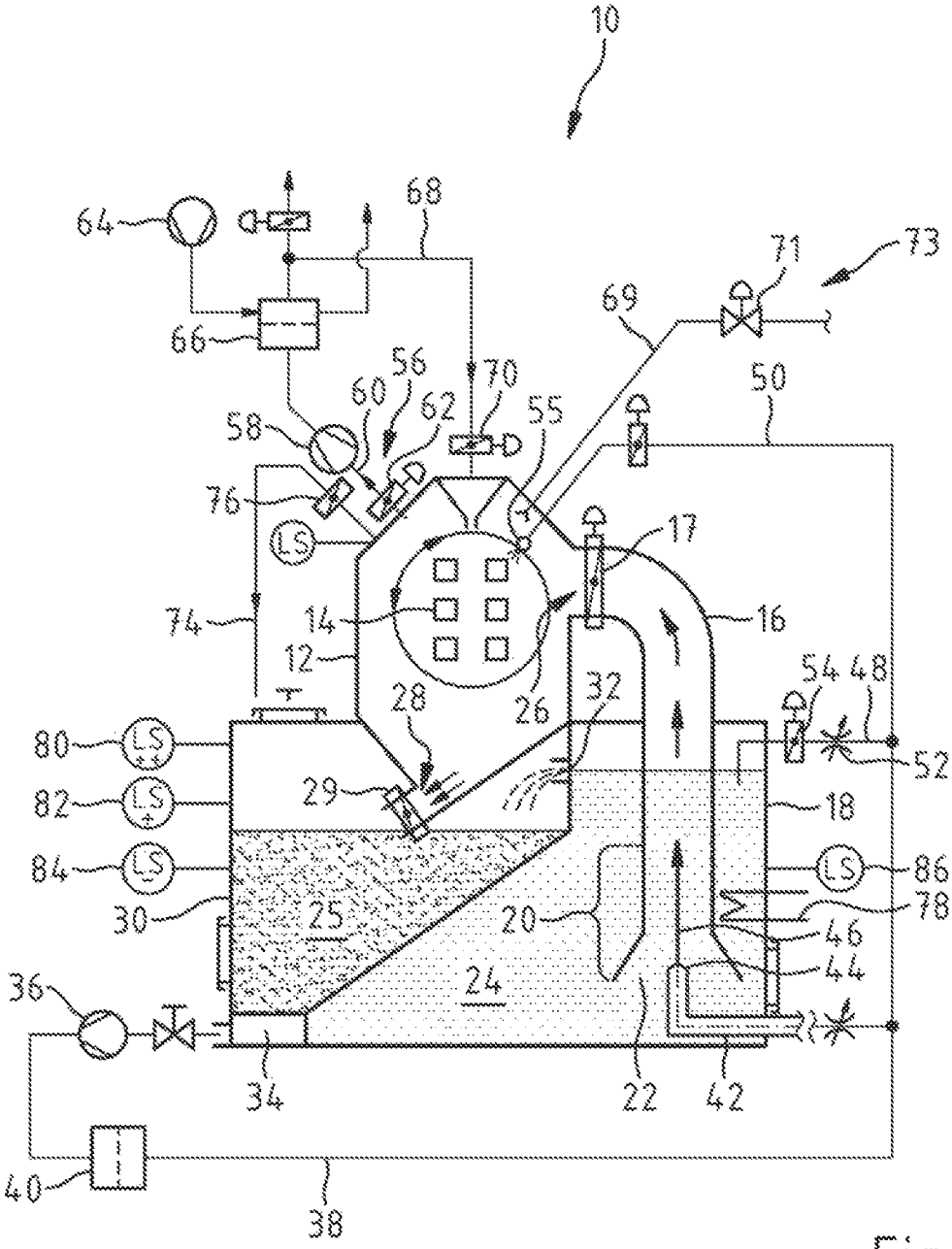
FIG. 1 shows a first example system for treating workpieces with process fluid in an example flooding chamber.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Systems for treating workpieces are disclosed. The examples disclosed herein relate to systems for treating workpieces using process fluid in a flooding chamber, which includes a container to provide process fluid.

Dirt particles (e.g., chip material, dust, casting sand or liquid droplets) may impair the function of industrially produced products such as, for example, injection nozzles for internal combustion engines. Thus, the cleanliness of workpieces in industrial production processes is of great importance. It is therefore useful in industrial manufacturing of systems to treat workpieces, in which the workpieces are cleaned and deburred. In such cleaning systems, the workpieces are subjected to a process fluid such as water, for example, which is provided, preferably, with cleaning additives, or to a fluid that may contain hydrocarbons.

A known example system of the type mentioned above is known from WO 2008/022701 A1, which is hereby incorporated by reference. This known system has a flooding chamber in which a workpiece that is to be cleaned may be positioned within, and contains a flooding apparatus that allows the flooding chamber to be provided/flooded with a process fluid in a liquid detergent form. The flooding apparatus includes a blower by which a negative pressure is able to be generated within the flooding apparatus. By way of the generated negative pressure, the detergent is drawn out (e.g., sucked out) of a container that acts as a detergent reservoir and into the flooding chamber.

It is the object of the examples disclosed herein to provide a system to treat workpieces that makes it possible to operate a flooding chamber for cleaning workpieces with short cycle times, and to specify a method for treating workpieces in a flooding chamber, by way of which a very significant (e.g., large) number of workpieces can be treated in a relatively short time duration.

This object is achieved by an example system having the features of claim 1 and a method with the features of claim 14. Advantageous embodiments of the invention are specified in the dependent claims.

Turning to FIG. 1, the example system 10 in FIG. 1 includes an example flooding chamber 12, in which one or more workpieces 14 can be positioned in to treat (e.g., to clean) the workpieces with process fluid. The example system 10 also includes an example process fluid delivery line 16 with an example controllable flooding flap 17 that opens into the flooding chamber 12 and projects into an example container 18, which is filled with the process fluid. The process fluid delivery line 16 of the illustrated example includes an inflow region 20 having an inlet opening 22 that is widened in a funnel-like shape, for example, and projects into (e.g., submerged in, has been dipped into) the process fluid 24 within the container 18.

The flooding chamber 12 has an opening 26 to provide the process fluid 24 from the container 18. The flooding chamber 12 can be flooded (e.g., filled) and/or provided with the process fluid 24 from the container 18 through the opening 26. To discharge the process fluid from the flooding chamber 12, the flooding chamber 12 of the illustrated example, additionally includes an opening 28 that has a controllable flooding flap 29, through which the process fluid 24 can be provided into a container 30.

Additionally, in some examples, it is also possible to feed the process fluid 24 from the container 18 into the container 30 via an overflow 32. The container 30 of the illustrated example serves to receive contaminated process fluid 25 and has a bottom portion 34 in which dirt particles, for example, which may include solids or chips, can settle out of the process fluid 25, for example. To discharge the dirt particles from the bottom portion 34, there is a conveying system, for example, which may preferably bet a scraper conveyor, of the example system 10. In some examples, the process fluid 24 can be returned to the container 18 from the bottom portion 34 of the container 30 via a delivery line 38, which contains a cleaning device 40 that has a self-cleaning filter system, by use of a delivery pump 36, for example. The delivery line 38 of the illustrated example includes a line branch 42 with a nozzle 44. The line branch 42 projects into the container 18 and thereby generates a process fluid jet 46, which flows coaxially through the container-side inflow region 20 and emerges from the nozzle 44. The outlet opening of the nozzle 44 is, in this example, positioned in a narrowing portion of the inflow region 20 of the process fluid delivery line 16. To this end, in this example, a portion of the line branch 42 that accommodates the nozzle 44 projects through the inlet opening 22 and into the process fluid delivery line 16.

In this example, the delivery line 38 has also includes a line branch 48 and a line branch 50, both of which are fluidly coupled in parallel with the line branch 42.

The line branch 48 of the illustrated example includes a throttle valve 52 and a shut-off valve 54. In this example, the line branch 48 acts as a bypass line through which the process fluid 24 can be circulated in the system 10 via the delivery pump 36 without the process fluid 24 for this purpose passing through the flooding chamber 12, for example. The line branch 50 of the illustrated example provides cleaning nozzles 55 positioned in the flooding chamber 12 with the process fluid 24.

In the illustrated example, the system 10 also includes a device 56 that generates a negative pressure within the flooding chamber 12. The example device 56 includes a blower 58, which is connected to the flooding chamber 12 via a suction line 60, in which a controllable valve 62 is positioned. The gaseous fluid drawn out of the flooding chamber 12 via the blower 58 is released to the environment via a vapor condenser 66 that is cooled by an additional blower 64, for example. The example fluid chamber 12 may be relieved of a positive pressure or a negative pressure via a pressure line 68 and a shut-off valve 70. The example system 10 also includes a device 73 to generate positive pressure in the flooding chamber 12 via a compressed-air line 69 and a shut-off valve 71, which includes a compressed-air reservoir to supply the fluid chamber 12 with compressed air, for example.

To treat a workpiece 14 with the process fluid 24 in the system 10, for example, in a first step of the illustrated example, the workpiece 14 is positioned in the flooding chamber 12. In a second step (e.g., following the first step) of this example, the flooding chamber 12 is then flooded/provided with the process fluid 24 from the container 18 and the delivery line 38. In the example process of FIG. 1, a negative pressure is applied to the fluid chamber 12 via the blower 58 of the device 56, where the flooding flap 17 of the process fluid delivery line 16 is opened. The process fluid 24 is, in this regard, then drawn (e.g., sucked) into the flooding chamber 12 from the container 18 via the process fluid delivery line 16, for example. Since the process fluid 24 of the illustrated example is additionally provided into the process fluid delivery line 16 via the delivery line 38 and the line branch 42 with the nozzle 44 as a process fluid jet 46 that passes in the axial direction through the container-side inflow region 20, thereby producing a Venturi effect that causes a hydrostatic pressure gradient and supports the suction of the process fluid 24 out of the container 18 and into the process fluid delivery line 16.

In this example, to discharge the process fluid 25 out of the flooding chamber 12 after it has acted on a workpiece positioned in the flooding chamber 12, in a third step, the flooding flap 17 in the process fluid delivery line 16 is closed and the flooding flap 29 of the flooding chamber 12 is opened. Simultaneously, compressed air is blown into the flooding chamber 12 via the pressure line 69 in order to push the process fluid 25 through the opening 28 and into the container 30, for example. When the process fluid 25 has been discharged (e.g., as soon as the process fluid 25 has been discharged) from the flooding chamber 12, the treated workpiece 14 may then be removed from the flooding chamber 12.

To establish relative pressure equalization (e.g., pressure equalization) between the flooding chamber 12 and the container 30, the example system 10 includes a pressure equalization line 74 with a shut-off valve 76. In this example, the pressure equalization line 74 connects (e.g., fluidly couples) the container 30 to the flooding chamber 12. To allow the temperature of process fluid to which a workpiece in the flooding chamber 12 is subjected to be controlled, in this example, the system 10 includes a heating device 78. The delivery pump 36 of the system 10 has, preferably, a pump capacity of approximately 30 kilowatt (kW) and, in this example, allows the delivery-side provision of a pump pressure, P, where $P \approx 9$ bar at a delivery volume of approximately 90 cubic meters per hour ($m^3/h$). From the line branch 48 acting as a bypass line in this example, the delivery pump 36 may be operated at a relatively constant (e.g., constant) pump capacity when the shut-off valve 54 is opened, for example. In the operating states of the system 10 in which the process fluid 24 is not fed to the flooding chamber 12, the delivery pump 36 of the illustrated example then circulates the process fluid 25 from the container 30 into the container 18. In this regard, continuous cleaning of the process fluid 25 in the system 10 is ensured by the filter device 40. The example system 10 also includes a control device, by which the delivery pump 36 and the valves and flaps provided therein may be controlled, for example. In some examples, in order for the control device to monitor the process liquid levels in the system, the control device is electrically coupled to an overfill-protection filling level sensor 80, which is positioned in the container 30, a working-level filling level sensor 82, a dry-protection filling level sensor 84 and a filling level sensor 86, which is positioned in the container 18, to monitor a working level of the process fluid 24 in the container 18. In some modified examples, it should be noted that the system 10 may also be configured without the line branches 48 and 50. In these modified examples, it is advantageous to include an additional throttle valve and a shut-off valve, which can be integrated into the line branch 42.

Figure 2:
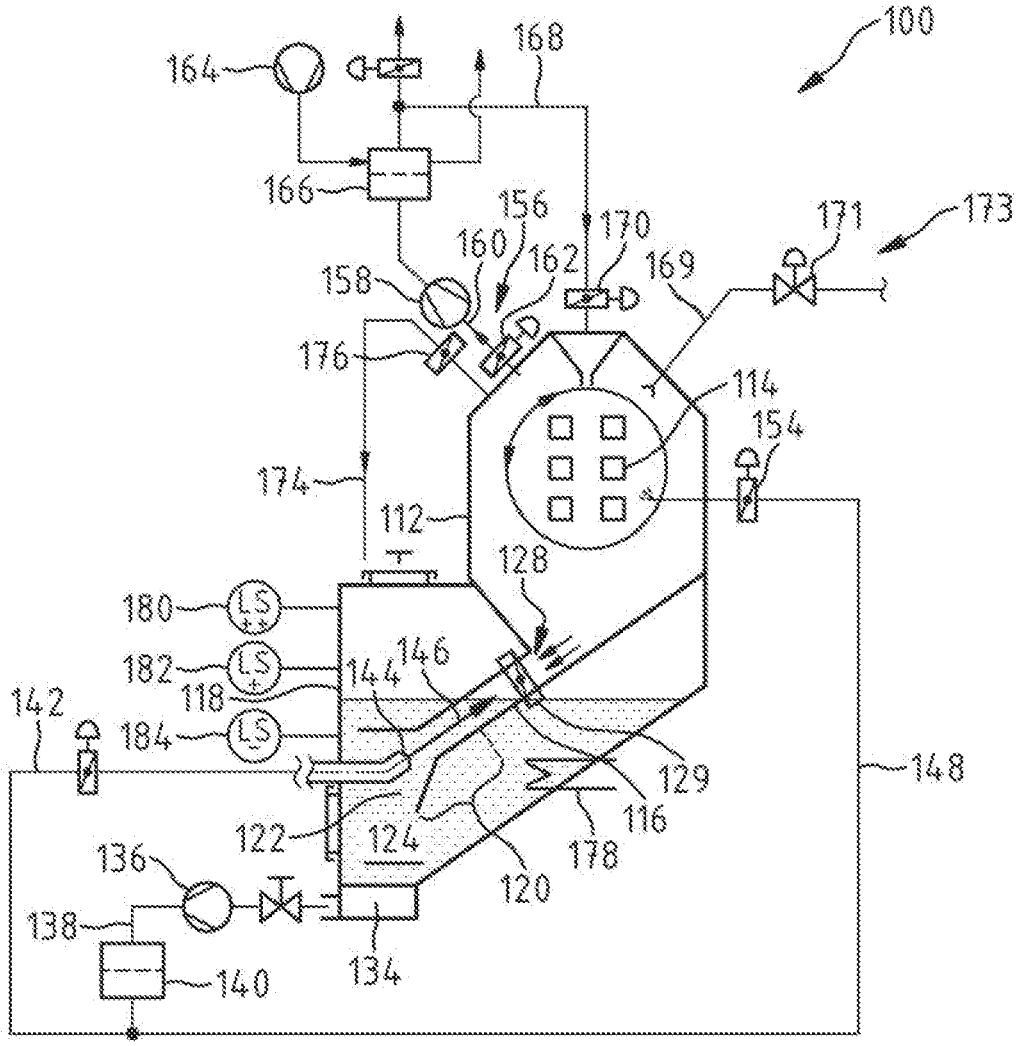
FIG. 2 shows a second example system for treating workpieces with a process fluid in another example flooding chamber.

Turning to FIG. 2, an example system 100, in contrast to the example system 10 of FIG. 1, has only a single container 118 to receive process fluid, which is provided to a flooding chamber 112. Subassemblies of the example system 100 that correspond to the subassemblies of the above-described system 10 are identified with numbers increased by 100 in relation to FIG. 1, as reference designators.

The flooding chamber 112 of the illustrated example has an opening 128. Through the opening 128, process fluid 124 can be provided to the flooding chamber 112 from the container 118 via a line 116. Conversely, in some examples, it is possible to discharge the process fluid 124 into the container 118 through a line 116 after a workpiece 114 has been treated in the flooding chamber 112. In this example, the line 116 has a controllable flooding flap 129, which enables shut off and opening of the flooding chamber 112 with respect to the container 118, for example.

The line 116 of the illustrated example is operated in the example system 100 as both a process fluid delivery line and as a line through which contaminated process fluid is provided to the container 118 from the flooding chamber 112 after a workpiece 114 has been treated. In this example, the line 116 also has an inflow region 120 with an inlet opening 122, which widens in a funnel-like manner and is dipped/projected into the process fluid 124 within the container 118.

The container 118 of the illustrated example has a bottom portion 134, in which dirt particles can settle from the process fluid 124. From the bottom portion 134 of the container 118, the process fluid 124 can, conversely, be returned to the container 118 via a delivery line 138, which contains a cleaning device 140 with a self-cleaning filter system, for example, by a delivery pump 136. To this end, in this example, the delivery line 138 has a line branch 142 that projects into the container 118 and includes a nozzle 144. The line branch 142 of the illustrated example generates a process fluid jet 146, which passes coaxially through the container-side inflow region 120 and emerges from the nozzle 144. The outlet opening of the nozzle 144 is, in this example, positioned in a narrowing portion of the inflow region 120 of the process fluid delivery line 116. To this end, in this example, the portion of the line branch 142 that accommodates the nozzle 144 projects into the inlet opening 122 and into the process fluid delivery line 116.

The delivery line 138 of the illustrated example also includes a line branch 148, which communicates (e.g., fluidly communicates) with the flooding chamber 112 and is coupled in parallel with the line branch 142. The example line branch 148 includes a shut-off valve 154, which can act, in this example, as a bypass line through which the process fluid 124 is able to be circulated in the system 100 via the flooding chamber 112 via the delivery pump 136.

In this example, to treat a workpiece 114 with the process fluid 124 in the example system 100 in a first example step, the workpiece 114 is positioned in the flooding chamber 112. In a second example step, the flooding chamber 112 is then provided/flooded with the process fluid 124, which is provided into the flooding chamber 112 from the container 118 via the delivery line 116 when the flooding flap 117 opened. In this example, a negative pressure is applied to the fluid chamber 112 via a blower 158 of a device 156. The process fluid 124 is then drawn (e.g., sucked) back from the container 118 into the flooding chamber 112 in this measure. Since the process fluid 124, in this example, is additionally fed through the delivery line 138 and the line branch 142 with the nozzle 144 extending into the process fluid delivery line 116 with the process fluid jet 146 that passes in the axial direction through the container-side inflow region 120, a resulting Venturi effect is likewise brought about in the inflow region 120. This Venturi effect supports the suction of the process fluid 124 from the container 118 and into the process fluid delivery line 116.

In summary, the following preferred features of the examples disclosed herein should be noted: Some of the examples disclosed herein relate to the example system 10 to treat the workpieces 14 with the process fluid 24 in the flooding chamber 12. The example system 10 has the container 18 to provide the process fluid 24. The example system 10 includes the process fluid delivery line 16 that connects (e.g. fluidly couples) the container 18 to the flooding chamber 12 in to provide the process fluid 24.

In a system according to the examples disclosed herein, provision is made for a process fluid delivery line that connects a container to a flooding chamber to feed process fluid. One aspect of the examples disclosed herein is, in particular, to provide a container-side inflow region for the process fluid delivery line in the system to generate a process fluid jet that passes through the process fluid delivery line in the axial direction in the inflow region. In this regard, it is possible to bring about a Venturi effect in the inflow region. This Venturi effect supports the flow of process fluid into the flooding chamber.

To this end, in some examples, the inflow region of the process fluid delivery line, favorably, includes an inlet opening that preferably faces a bottom of the container and through which the process fluid can pass into the process fluid delivery line from the container via a portion of the inflow region that preferably narrows in a funnel-like shape, for example.

In some examples, since the process fluid jet is made to flow through a portion of the inflow region that narrows in a funnel-like manner, the suction effect generated for the process fluid in the container by the Venturi effect in the inflow region may be enhanced.

A finding of the examples disclosed is, in particular, that it is possible to increase (e.g., maximize) a quantity of process fluid that can be moved per unit time out of the container, via the process fluid delivery line and into the flooding chamber, in that the process fluid jet is generated in the inflow region by a nozzle. This nozzle is positioned in a line branch of a line for process fluid which projects into the container. In a preferred example of the system according to the examples disclosed herein to treat workpieces, this nozzle is positioned in the portion of the inflow region of the process fluid delivery line that narrows in a funnel-like shape, for example. The portion of the line branch that accommodates the nozzle may, for this purpose, project, for example, through the inlet opening of the process fluid delivery line and into the inflow region thereof.

However, in an additional example system in accordance with the examples disclosed herein, the system may also have a nozzle to generate a process fluid jet, where the nozzle is located outside the process fluid delivery line and immediately upstream of the inlet opening thereof.

Preferably, the example systems disclosed herein contain a device to generate a negative pressure in the flooding chamber to fill the flooding chamber with process fluid from the container via the process fluid delivery line. In these examples, the flooding chamber has an opening for the inlet of process fluid and an opening for the outlet of process fluid. The opening in the flooding chamber corresponds to the inlet of process fluid and the opening for the outlet of process fluid may, in some examples, be identical (e.g., integral, unitary).

To allow contaminated process fluid to be released quickly from the flooding chamber, in some examples, process fluid may be pushed out of the flooding chamber via the opening for the outlet of process fluid such that a positive pressure is generated in the flooding chamber, for example, via compressed air.

The examples disclosed herein may also contain a container to receive contaminated process fluid, where the process fluid is to be supplied to the container from the flooding chamber via the opening for the outlet of process fluid, for example. Advantageously, in some examples, the container to provide process fluid has an overflow, through which process fluid can pass into the container that receives process fluid.

In a system according to the examples disclosed herein, the container to receive contaminated process fluid and the container to provide process fluid are to be integral.

To allow the flooding chamber to be rapidly supplied with process fluid, in some examples, it is favorable for the means to generate a process fluid jet, which passes through the container-side inflow region of the process fluid delivery line in the axial direction, to include a pump, which moves process fluid out of the container that receives contaminated process fluid through a cleaning device to separate dirt particles, and a line having an outlet opening for generating the process fluid jet.

By use of a bypass line that fluidly communicates with the cleaning device to provide process fluid used for cleaning in the cleaning device into the container for providing process fluid, continuous cleaning of process fluid in the system is allowed. Additionally or alternatively, it is possible to also provide a bypass line that fluidly communicates with the cleaning device to provide process fluid cleaned within the cleaning device into the flooding chamber.

In a method according to the examples disclosed herein to treat workpieces with process fluid in a flooding chamber, in an example first step, the workpiece is positioned in the flooding chamber. In a second example step, a negative pressure is then generated in the flooding chamber. Then, in a third example step, the process fluid is drawn (e.g., sucked) out of a container to provide process fluid through a process fluid delivery line with a container-side inflow region, where an additional process fluid jet is generated in the container-side inflow region. In this example, the process fluid jet generates a hydrostatic pressure gradient that moves the process fluid into the process fluid delivery line.

One aspect of the examples disclosed is, in particular, that the additional process fluid jet is generated with contaminated process fluid passed through a cleaning device.

One example system for treating workpieces 14, 114 with process fluid 24, 124 in a flooding chamber 12, 112 includes a container 18, 118 for providing process fluid 24, 124, where a process fluid delivery line 16, 116 that connects the container 18, 118 to the flooding chamber 12, 112 is to provide process fluid 24, 124.

In some examples, the process fluid delivery line 16, 116 has a container-side inflow region 20, 120, and means 44, 144 are provided for generating a process fluid jet that passes through the container-side inflow region 20, 120 of the process fluid delivery line 16, 116. In some examples, the container-side inflow region 20, 120 of the process fluid delivery line 16, 116 has an inlet opening 22, 122 widened in a funnel shape. In some examples, the system further includes a device 56 for generating a negative pressure in the flooding chamber 12, 112 in order to fill the flooding chamber 12, 112 with process fluid 24, 124 from the container 18, 118 via the process fluid delivery line 16, 116.

In some examples, the flooding chamber 12, 112 has an opening 26, 126 for the inlet of process fluid 24, 124 and an opening 28, 128 for the outlet of process fluid 24, 124. In some examples, the opening 128 for the inlet of process fluid 124 and the opening 128 for the outlet of process fluid 124 are unitary. In some examples, the system further includes a device for generating a positive pressure in the flooding chamber 12, 112 in order to push process fluid 24, 124 located in the flooding chamber 12, 112 out of the flooding chamber 12, 112 via the opening 28, 128 for the outlet of process fluid 24, 124. In some examples, the system further includes a container 30, 118 for receiving contaminated process fluid, it being possible for process fluid 24, 124 to be supplied to said container 30, 118 from the flooding chamber 12, 112 via the opening 28, 128 for the outlet of process fluid 24, 124.

In some examples, the container 18 for providing process fluid has an overflow 32 for feeding process fluid into the container 30 for receiving process fluid. In some examples, the container 118 for receiving contaminated process fluid 124 and the container 118 for providing process fluid 24, 124 are integral (e.g., unitary). In some examples, the means for generating a process fluid jet 46, 146 that passes through the container-side inflow region 20, 120 of the process fluid delivery line 16, 116 comprises a pump 36, 136, which moves process fluid 24, 124 out of the container 30, 118 for receiving contaminated process fluid 24, 124 through a cleaning device 40, 140 for separating dirt particles out of the process fluid 24, 124 and a line branch 142 having an outlet opening for generating the process fluid jet 46, 146. In some examples, the system further includes a bypass line, communicating with the cleaning device 40, for feeding process fluid 24 cleaned in the cleaning device 40 into the container 18 for providing process fluid 24. In some examples, the system further includes a bypass line, communicating with the cleaning device 40, 140, for feeding process fluid 24, 124 cleaned in the cleaning device 40, 140 into the flooding chamber 12, 112.

One example method for treating workpieces 14, 114 with process fluid 24, 124 in a flooding chamber 12, 112 includes a first step where the workpiece is arranged in the flooding chamber 12, 112, a second step where a negative pressure is generated in the flooding chamber 12, 112, and a third step where process fluid 24, 124 is sucked out of a container 18, 118 for providing process fluid 24, 124 through a process fluid delivery line 16, 116 having a container-side inflow region 20, 120, where a process fluid jet 46, 146 is generated in the container-side inflow region 20, 120, said process fluid jet 46, 146 bringing about a hydrostatic pressure gradient that moves the process fluid 24, 124 into the process fluid delivery line 16, 116.

In some examples, the additional process fluid jet 46, 146 is generated with contaminated process fluid 24, 124 passed through a cleaning device 40, 140.

An example system for treating workpieces with process fluid in a flooding chamber includes a container to provide process fluid, a process fluid delivery line that fluidly couples the container to the flooding chamber to provide process fluid to the flooding chamber, where the process fluid delivery line includes a container-side inflow region, and means for generating a process fluid jet that is to flow to the flooding chamber and pass through the container-side inflow region of the process fluid delivery line.

In some examples, the container-side inflow region includes an inlet opening widened in a funnel shape. In some examples, the system further includes a device to generate a negative pressure in the flooding chamber to fill the flooding chamber with process fluid from the container via the process fluid delivery line. In some examples, the flooding chamber includes an opening corresponding to the inlet of process fluid and an opening corresponding the outlet of process fluid. In some examples, the system further includes a device to generate a positive pressure in the flooding chamber to push process fluid located in the flooding chamber out of the flooding chamber via the opening for the outlet of process fluid. In some examples, the system further includes a container for receiving contaminated process fluid, where process fluid is to be supplied to the container for receiving contaminated process fluid from the flooding chamber via the opening for the outlet of process fluid.

In some examples, the container for providing process fluid includes an overflow to provide process fluid into the container for receiving contaminated process fluid. In some examples, where the container for receiving contaminated process fluid and the container for providing process fluid are integral. In some examples, the opening for the inlet of process fluid and the opening for the outlet of process fluid are unitary. In some examples, the means for generating a process fluid jet that passes through the container-side inflow region of the process fluid delivery line includes a pump to move process fluid out of the container for receiving contaminated process fluid through a cleaning device to separate dirt particles out of the process fluid and a line branch having an outlet opening for generating the process fluid jet.

In some examples, the system further includes a bypass line in fluid communication with the cleaning device, where the bypass line is to provide process fluid cleaned in the cleaning device into the container for providing process fluid. In some examples, the system further includes a bypass line in fluid communication with the cleaning device, where the bypass line is to provide process fluid cleaned in the cleaning device into the flooding chamber.

One example method for treating workpieces with process fluid in a flooding chamber includes positioning, in a first step, a workpiece in the flooding chamber, generating, in a second step, a negative pressure in the flooding chamber, and drawing, in a third step, process fluid out of a container for providing process fluid through a process fluid delivery line having a container-side inflow region, where a process fluid jet is generated in the container-side inflow region, where the process fluid jet is to cause a hydrostatic pressure gradient that moves the process fluid into the process fluid delivery line. In some examples, where an additional process fluid jet is generated with contaminated process fluid that is passed through a cleaning device.

One example apparatus includes a flooding chamber to receive a workpiece, and a container that stores process fluid. The example apparatus also includes a process fluid delivery line fluidly coupling the container to the flooding chamber, where the process fluid delivery line includes an inlet end that is submerged in the process fluid and with a converging opening inlet shape. The example apparatus also includes a pump to draw or push the process fluid out of the container via the process fluid delivery line and into the flooding chamber by generating a process fluid jet at the inlet end of the process fluid delivery line, the process fluid jet is to cause a hydrostatic pressure gradient that moves the process fluid into the process fluid delivery line.

In some examples, the apparatus further includes a control flap between the flooding chamber and the process fluid delivery line. In some examples, the control flap includes the first control flap, and the apparatus further includes a second control flap between a contaminated process fluid reservoir and the flooding chamber. In some examples, the pump is fluidly coupled to an inlet of the container. In some examples, the pump includes an air pump proximate the flooding chamber. In some examples, the apparatus further includes a bypass line and a cleaning device, where the bypass line and the cleaning device are to provide cleaned process fluid to the container.

This patent arises as a continuation-in-part of International Patent Application No. PCT/EP2014/053632, which was filed on Feb. 25, 2014, which claims priority to German Patent Application No. 10 2013 203 059, which was filed on Feb. 25, 2013. The foregoing International Patent Application and German Patent Application are hereby incorporated herein by reference in their entireties.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A system for treating workpieces with process fluid in a flooding chamber comprising:

a container to provide process fluid;

a process fluid delivery line that fluidly couples the container to the flooding chamber to provide process fluid to the flooding chamber, wherein the process fluid delivery line includes a container-side inflow region; and means for generating a process fluid jet that is to flow to the flooding chamber and pass through the container-side inflow region of the process fluid delivery line, the means for generating the process fluid jet including a delivery line having a line branch with a nozzle for generating the process fluid jet into the process fluid delivery line, wherein the nozzle and at least a portion of the line branch are submerged within the process fluid.

2. The system as defined in claim 1, wherein the container-side inflow region includes an inlet opening widened in a funnel shape.

3. The system as defined in claim 1, further including a device to generate a negative pressure in the flooding chamber to fill the flooding chamber with process fluid from the container via the process fluid delivery line.

4. The system as claimed in claim 1, wherein the flooding chamber includes an opening corresponding to an inlet of process fluid and an opening corresponding to exit of process fluid.

5. The system as defined in claim 4, further including a device to generate a positive pressure in the flooding chamber to push process fluid located in the flooding chamber out of the flooding chamber via the opening for exit of the process fluid.

6. The system as defined in claim 4, further including a container for receiving contaminated process fluid, wherein the process fluid is to be supplied to the container for receiving contaminated process fluid from the flooding chamber via the opening for exit of process fluid.

7. The system as claimed in claim 6, wherein the container for providing process fluid includes an overflow to provide process fluid into the container for receiving contaminated process fluid.

8. The system as claimed in claim 6, wherein the container for receiving contaminated process fluid and the container for providing process fluid are integral.

9. The system as defined in claim 7, wherein the means for generating the process fluid jet that passes through the container-side inflow region of the process fluid delivery line includes a pump to move process fluid out of the container for receiving contaminated process fluid through a cleaning device to separate dirt particles out of the process fluid.

10. The system as defined in claim 9, further including a bypass line in fluid communication with the cleaning device, the bypass line to provide process fluid cleaned in the cleaning device into the container for providing process fluid.

11. The system as defined in claim 9, further including a bypass line in fluid communication with the cleaning device, the bypass line to provide process fluid cleaned in the cleaning device into the flooding chamber.

12. The system as claimed in claim 4, wherein the opening for ingress of process fluid and the opening for exit of process fluid are unitary.

13. An apparatus comprising:

a flooding chamber to receive a workpiece, a container that stores process fluid;

a process fluid delivery line fluidly coupling the container to the flooding chamber, the process fluid delivery line including an inlet end that is submerged in the process fluid and with a converging opening inlet shape;

a line branch of the process fluid delivery line, the line branch including a nozzle, wherein the nozzle and at least a portion of the line branch are submerged within the process fluid; and a pump to draw or push the process fluid out of the container via the line branch and the nozzle of the process fluid delivery line and into the flooding chamber by generating a process fluid jet at the nozzle, the process fluid jet to cause a hydrostatic pressure gradient that moves the process fluid into the process fluid delivery line and the flooding chamber.

14. The apparatus as defined in claim 13, further including a control flap between the flooding chamber and the process fluid delivery line.

15. The apparatus as defined in claim 14, wherein the control flap includes the first control flap, and further including a second control flap between a contaminated process fluid reservoir and the flooding chamber.

16. The apparatus as defined in claim 13, wherein the pump is fluidly coupled to an inlet of the container.

17. The apparatus as defined in claim 13, wherein the pump includes an air pump positioned at the flooding chamber.

18. The apparatus as defined in claim 13, further including a bypass line and a cleaning device, wherein the bypass line and the cleaning device are to provide cleaned process fluid to the container.

* * * * *